US011518954B2

(12) United States Patent
Delbridge et al.

(10) Patent No.: US 11,518,954 B2
(45) Date of Patent: Dec. 6, 2022

(54) ZINC-FREE LUBRICATING COMPOSITION

(71) Applicant: The Lubrizol Corporation, Wickliffe, OH (US)

(72) Inventors: Ewan E. Delbridge, Concord Township, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 17/226,605

(22) Filed: Apr. 9, 2021

(65) Prior Publication Data

US 2021/0230497 A1 Jul. 29, 2021

Related U.S. Application Data

(63) Continuation of application No. 15/746,144, filed as application No. PCT/US2016/042886 on Jul. 19, 2016, now Pat. No. 10,988,702.

(60) Provisional application No. 62/253,906, filed on Nov. 11, 2015, provisional application No. 62/194,513, filed on Jul. 20, 2015.

(51) Int. Cl.

| | |
|---|---|
| ***C10M 135/10*** | (2006.01) |
| ***C10M 137/12*** | (2006.01) |
| ***C10M 137/04*** | (2006.01) |
| ***C10M 133/06*** | (2006.01) |
| ***C10M 133/46*** | (2006.01) |
| ***C10M 129/54*** | (2006.01) |
| ***C10M 133/12*** | (2006.01) |
| ***C10M 149/10*** | (2006.01) |
| ***C10M 169/04*** | (2006.01) |
| ***C10M 137/08*** | (2006.01) |
| *C10N 20/04* | (2006.01) |
| *C10N 20/00* | (2006.01) |
| *C10N 30/04* | (2006.01) |
| *C10N 30/06* | (2006.01) |
| *C10N 30/10* | (2006.01) |

(Continued)

(52) U.S. Cl.

CPC ..... *C10M 137/12* (2013.01); *C10M 129/54* (2013.01); *C10M 133/06* (2013.01); *C10M 133/12* (2013.01); *C10M 133/46* (2013.01); *C10M 135/10* (2013.01); *C10M 137/04* (2013.01); *C10M 137/08* (2013.01); *C10M 149/10* (2013.01); *C10M 169/04* (2013.01); *C10M 169/044* (2013.01); *C10M 2203/1025* (2013.01); *C10M 2205/022* (2013.01); *C10M 2207/127* (2013.01); *C10M 2207/144* (2013.01); *C10M 2207/289* (2013.01); *C10M 2215/04* (2013.01); *C10M 2215/042* (2013.01); *C10M 2215/06* (2013.01); *C10M 2215/064* (2013.01); *C10M 2215/221* (2013.01); *C10M 2215/224* (2013.01); *C10M 2215/26* (2013.01); *C10M 2215/28* (2013.01); *C10M 2215/30* (2013.01); *C10M 2217/028* (2013.01); *C10M 2219/022* (2013.01); *C10M 2219/044* (2013.01); *C10M 2219/089* (2013.01); *C10M 2223/04* (2013.01); *C10M 2223/043* (2013.01); *C10M 2223/049* (2013.01); *C10M 2223/06* (2013.01); *C10M 2223/063* (2013.01); *C10N 2020/04* (2013.01); *C10N 2020/077* (2020.05); *C10N 2030/04* (2013.01); *C10N 2030/06* (2013.01); *C10N 2030/10* (2013.01); *C10N 2030/40* (2020.05); *C10N 2030/42* (2020.05); *C10N 2030/45* (2020.05); *C10N 2030/52* (2020.05); *C10N 2040/25* (2013.01); *C10N 2040/255* (2020.05)

(58) Field of Classification Search

CPC ..... C10M 137/12; C10M 129/54; C10M 133/06; C10M 133/12; C10M 133/46; C10M 135/10; C10M 137/04; C10M 137/08; C10M 149/10; C10M 169/04; C10M 169/044; C10M 2203/1025; C10M 2205/022; C10M 2207/127; C10M 2207/144; C10M 2207/289; C10M 2215/04; C10M 2215/042; C10M 2215/06; C10M 2215/064; C10M 2215/221; C10M 2215/224; C10M 2215/26; C10M 2215/28; C10M 2215/30; C10M 2217/028; C10M 2219/022; C10M 2219/044; C10M 2219/089; C10M 2223/04; C10M 2223/043; C10M 2223/049; C10M 2223/06; C10M 2223/063; C10N 2020/04; C10N 2020/077; C10N 2030/04; C10N 2030/06; C10N 2030/10; C10N 2030/40; C10N 2030/42; C10N 2030/45; C10N 2030/52; C10N 2040/25; C10N 2040/255

USPC ..... 508/547, 403

See application file for complete search history.

(56) References Cited

U.S. PATENT DOCUMENTS

| | | | |
|---|---|---|---|
| 3,172,892 | A | 3/1965 | LeSuer |
| 3,197,405 | A | 7/1965 | LeSuer |

(Continued)

FOREIGN PATENT DOCUMENTS

| | | | |
|---|---|---|---|
| CA | 1183125 | A1 | 2/1985 |
| EP | 0355895 | B1 | 12/1994 |

(Continued)

*Primary Examiner* — Prem C Singh
*Assistant Examiner* — Francis C Campanell
(74) *Attorney, Agent, or Firm* — Michael Miller

(57) ABSTRACT

The invention is directed to a zinc-free lubricating composition for an internal combustion engine containing a phosphorus anti-wear agent, an ashless antioxidant, and a metal-free basic detergent. The lubricating composition provides wear protection, deposit control, and improved acid control with reduced levels of metal-containing additives.

12 Claims, No Drawings

(51) Int. Cl.
*C10N 30/00* (2006.01)
*C10N 40/25* (2006.01)

(56) References Cited

U.S. PATENT DOCUMENTS

| | | | |
|---|---|---|---|
| 3,219,666 | A | 11/1965 | Norman et al. |
| 3,316,177 | A | 4/1967 | Dorer, Jr. |
| 3,340,281 | A | 9/1967 | Brannan, Jr. |
| 3,351,552 | A | 11/1967 | LeSuer |
| 3,381,022 | A | 4/1968 | LeSuer |
| RE26,433 | E | 8/1968 | LeSuer et al. |
| 3,433,744 | A | 3/1969 | LeSuer |
| 3,444,170 | A | 5/1969 | Norman et al. |
| 3,467,668 | A | 9/1969 | Gruber et al. |
| 3,501,405 | A | 3/1970 | Willette |
| 3,542,680 | A | 11/1970 | LeSuer |
| 3,576,743 | A | 4/1971 | Widmer et al. |
| 3,632,511 | A | 1/1972 | Chien-Wei |
| 3,962,104 | A | 6/1976 | Swietlik et al. |
| 4,234,435 | A | 11/1980 | Meinhardt et al. |
| 4,863,623 | A | 9/1989 | Nalesnik |
| 6,107,257 | A | 8/2000 | Valcho et al. |
| 6,107,258 | A | 8/2000 | Eshe, Jr. et al. |
| 6,117,825 | A | 9/2000 | Liu et al. |
| 6,153,565 | A | 11/2000 | Skinner et al. |
| 6,165,235 | A | 12/2000 | Kolp et al. |
| 6,281,179 | B1 | 8/2001 | Skinner et al. |
| 6,429,178 | B1 | 8/2002 | Skinner et al. |
| 6,429,179 | B1 | 8/2002 | Skinner et al. |
| 7,009,072 | B2 | 3/2006 | Muir |
| 7,238,650 | B2 | 7/2007 | Calder et al. |
| 7,285,516 | B2 | 10/2007 | Carrick et al. |
| 7,407,919 | B2 | 8/2008 | Wilk et al. |
| 7,790,661 | B2 | 9/2010 | Covitch et al. |
| 8,399,388 | B2 | 3/2013 | Campbell et al. |
| 2005/0026792 | A1 | 2/2005 | Cartwright |
| 2005/0043191 | A1 | 2/2005 | Farng et al. |
| 2005/0137096 | A1 | 6/2005 | Yoon et al. |
| 2005/0198894 | A1 | 9/2005 | Migdal et al. |
| 2006/0247140 | A1 | 11/2006 | Cressey et al. |
| 2007/0111905 | A1 | 5/2007 | Van Dam |
| 2010/0197536 | A1 | 8/2010 | Mosier et al. |
| 2011/0009300 | A1 | 1/2011 | Eloman et al. |
| 2011/0297122 | A1 | 12/2011 | Bardasz |
| 2012/0040876 | A1 | 2/2012 | Preston et al. |
| 2012/0101012 | A1 | 4/2012 | Delbridge et al. |
| 2014/0057818 | A1* | 2/2014 | Barton ..... C10M 129/76 508/376 |

FOREIGN PATENT DOCUMENTS

| | | | |
|---|---|---|---|
| WO | 2006/015130 | A1 | 2/2006 |
| WO | 2006/044411 | A1 | 4/2006 |
| WO | 2006/047486 | A1 | 5/2006 |
| WO | 2010/014655 | A1 | 7/2008 |
| WO | 2008/147704 | A1 | 12/2008 |
| WO | 2016/164345 | A1 | 10/2016 |

* cited by examiner

ZINC-FREE LUBRICATING COMPOSITION

CROSS-REFERENCE TO RELATED APPLICATION

This application is a continuation application of application Ser. No. 15/746,144 filed on Jan. 19, 2018, which claims priority from PCT International Application Serial No. PCT/US2016/042886 filed on Jul. 19, 2016, which claims benefit of U.S. Provisional Application Ser. No. 62/253,906 filed on Nov. 11, 2015 and on Provisional Application Ser. No. 62/194,513 filed on Jul. 20, 2015.

BACKGROUND OF THE INVENTION

The disclosed technology relates to zinc-free lubricants for internal combustion engines, which contain metal-free additives to provide basicity to the lubricant as well as zinc-free phosphorus anti-wear additives.

Lubrication of internal combustion engines has been a practice for many decades, yet continual improvement in lubricant technology is ongoing as new engines and new standards have been developed. Formulations directed to spark ignition engines and compression ignition engines, for instance, must address limits placed on sulfated ash, phosphorus, and sulfur content ("SAPS"), and restrictions in these components often lead to upper limits on the amount of metal-containing additives that can be included in the lubricant. Reduction in metal containing additives is necessary to reduce the impact of metal ash on exhaust aftertreatment devices and to reduce the emission of particulate matter.

Chief among these metal-containing additives are zinc dialkyldithiophosphates (ZDDP) for wear and oxidation protection and overbased metal detergents for cleanliness and acid control. ZDDP has been the industry standard for reducing valve train wear, protecting against liner wear, and reducing oxidation leading to corrosive wear. However, the zinc contributes to an increase in sulfated ash in the lubricating oil and the phosphorus causes inactivation of oxidation catalysts used in exhaust after-treatment devices.

One of the benefits that metal-containing detergents provide to the lubricant is basicity (measurable as total base number or TBN, ASTM D2896), which is available for various functions, including neutralization of acidic byproducts of combustion. Metal-containing detergents and the TBN that they provide are associated with the ability of a lubricant to protect the engine from corrosive wear and maintaining that protection over an extended period of time.

The formulation of engine oils which contain reduced metal content (often expressed as sulfated ash, ASTM D 874) but sufficient basicity to adequately neutralize acidic combustion products while continuing to provide good protection to engine components has remained elusive. Low ash is desirable to minimize fouling of catalysts and other pollution control devices in the exhaust stream, which may be caused by migration of metal ions from the lubricant into the exhaust system. Metal containing detergents, however, and especially overbased metal-containing detergents, have long been a key to protecting engine parts from attack by acidic exhaust components that may enter the lubricant system by piston ring blow-by. It is desirable to attain these seemingly contradictory goals while still providing excellent lubrication and protection to the engine.

U.S. Patent Publication 2012-0101012 discloses low and no-ash detergents derived from quaternary pnictogen compounds The document discloses compositions including ZDDP as a preferred antiwear agent. The examples include 0.88 weight percent of ZDDP.

U.S. Patent Publication 2011-0297122 discloses a low ash, zinc-free consumable lubricant composition for use in an internal combustion engine equipped with a pilot ignition system.

U.S. Patent Publication 2007-0111905 discloses lubricant compositions for heavy duty diesel engines which are free of zinc dialkyldithiophosphates. These compositions contain metal-containing detergents, preferably calcium sulfonate and/or calcium phenate detergents.

U.S. Patent Publication 2005-0043191 discloses a substantially zinc and phosphorus free lubricating oil which contains an additive system containing metal detergents, at least one borated ashless dispersant, at least an amine anti-oxidant and a tri-nuclear molybdenum compound. The lubricant contains a minimum of 120 ppm boron and a minimum of 80 ppm molybdenum.

U.S. Patent Publication 2005-0026792 discloses a lubricating oil composition with very low phosphorus content, and having long life as evidenced by a reduction in viscosity increase, oxidation and nitration, comprises a major amount of a base oil of lubricating viscosity and a minor amount of a mixer of neutral and overbased metallic detergents, at least a zinc di-alkyl dithiocarbamate anti-wear additive and at least a di-hydrocarboxylthiocarbamoyl.

U.S. Patent Publication 2005-0137096 discloses an engine lubricant that is substantially free of zinc and phosphorus contains an anti-wear additive comprising borated 1,2-epoxy mixed polybutenes having an average carbon number in the range of C20 to C120.

U.S. Patent Publication 2012-0040876 discloses anthranilic esters as additives in lubricants. This document discloses compositions that are said to deliver an ash-free base to a lubricant in the form of a basic amine additive, without adversely impacting seal compatibility.

U.S. Patent Publication 2006-0247140 discloses a reaction product of a basic nitrogen compound (i.e. an amine) and an acidic aromatic compound to produce a metal-free detergent with TBN ranging from 3 up to 80 mg KOH/g. Metal free detergents made in this manner from organic acids result in protic salts that produce basicity (TBN) and acidity (TAN) to the lubricant composition.

The disclosed technology provides a lubricant composition for an internal combustion engine wear protection, deposit control, and improved acid control.

SUMMARY OF THE INVENTION

The disclosed technology provides a zinc-free lubricating composition comprising (a) an oil of lubricating viscosity, (b) a zinc-free phosphorus-containing antiwear agent, (c) at least one ashless detergent comprising a basic quaternary pnictogen salt, and (d) an ashless antioxidant, wherein the ashless detergent has a total base number (D2896) of at least 25 mg KOH/g and a total acid number (TAN) of less than 5 mg KOH/g as measured by ASTM D664.

The disclosed technology provides a zinc-free lubricating composition comprising (a) an oil of lubricating viscosity; (b) a phosphorous-containing anti-wear agent; (c) at least one ashless detergent comprising a basic quaternary pnictogen salt (typically chosen from a hydroxide, carbonate, or bicarbonate); and (d) an ashless antioxidant, wherein the lubricating composition is free or substantially free of zinc (typically 0 ppm to 250 ppm, or 0 to 100 ppm or 0 to 50 ppm of zinc, or 0 ppm of zinc by weight), wherein the ashless detergent has a total acid number (TAN) of less than 5 mg KOH/g as measured by ASTM D664.

The disclosed technology provides a metal-free lubricating composition comprising (a) an oil of lubricating viscosity; (b) a zinc-free phosphorous-containing anti-wear agent; (c) at least one ashless detergent comprising a basic quaternary pnictogen salt (typically chosen from a hydroxide, carbonate, or bicarbonate); and (d) an ashless antioxidant. wherein the lubricating composition is free or substantially free of metal (typically 0 ppm to 250 ppm, or 0 to 100 ppm or 0 to 50 ppm of metal, or 0 ppm of metal by weight), wherein the ashless detergent has a total acid number (TAN) of less than 5 mg KOH/g as measured by ASTM D664.

The invention further provides a method of lubricating a spark ignited or compression ignited internal combustion engine with a zinc-free lubricant composition comprising (a) an oil of lubricating viscosity; (b) a zinc-free phosphorous-containing anti-wear agent; (c) at least one ashless detergent comprising a basic quaternary pnictogen salt (typically chosen from a hydroxide, carbonate, or bicarbonate); and (d) an ashless antioxidant. wherein the lubricating composition is free or substantially free of zinc (typically 0 ppm to 250 ppm, or 0 to 100 ppm or 0 to 50 ppm of zinc, or 0 ppm of zinc by weight), wherein the ashless detergent has a total acid number (TAN) of less than 5 mg KOH/g as measured by ASTM D664.

The invention further provides a method of neutralizing acid build-up in an internal combustion lubricated with a metal-free lubricant composition, wherein the lubricant composition comprises (a) an oil of lubricating viscosity; (b) a phosphorous-containing anti-wear agent; (c) at least one ashless detergent comprising a basic quaternary pnictogen salt (typically chosen from a hydroxide, carbonate, or bicarbonate); and (d) an ashless antioxidant. wherein the lubricating composition is free or substantially free of metal (typically 0 ppm to 250 ppm, or 0 to 100 ppm or 0 to 50 ppm of metal, or 0 ppm of metal by weight), wherein the ashless detergent has a total acid number (TAN) of less than 5 mg KOH/g as measured by ASTM D664.

The invention further provides the method described herein in which the engine is fueled with a liquid hydrocarbon fuel, a liquid nonhydrocarbon fuel, or mixtures thereof.

The invention further provides the method described herein in which the engine is fueled by natural gas, liquefied petroleum gas (LPG), compressed natural gas (CNG), or mixtures thereof.

The invention further provides a lubricant composition comprising (a) an oil of lubricating viscosity; (b) a zinc-free phosphorous-containing anti-wear agent; (c) at least one ashless detergent comprising a basic quaternary pnictogen salt (typically chosen from a hydroxide, carbonate, or bicarbonate); and (d) an ashless antioxidant, wherein the lubricating composition is free or substantially free of metal (typically 0 ppm to 250 ppm, or 0 to 100 ppm or 0 to 50 ppm of metal, or 0 ppm of metal by weight), wherein the ashless detergent has a total acid number (TAN) of less than 5 mg KOH/g as measured by ASTM D664, and further including at least one other additive selected from an ashless dispersant, a friction modifier, an ashless phosphorus-free anti-wear agent, a polymeric viscosity modifier, and a corrosion inhibitor.

The invention further provides a lubricating composition comprising (a) an oil of lubricating viscosity; (b) a zinc-free phosphorous-containing anti-wear agent; (c) at least one ashless detergent comprising a basic quaternary pnictogen salt (typically chosen from a hydroxide, carbonate, or bicarbonate); and (d) an ashless antioxidant. wherein the lubricating composition is free or substantially free of metal (typically 0 ppm to 250 ppm, or 0 to 100 ppm or 0 to 50 ppm of metal, or 0 ppm of metal by weight), wherein the ashless detergent has a total acid number (TAN) of less than 5 mg KOH/g as measured by ASTM D664, and further including a polyalkenyl succinimide dispersant in an amount from 0.5 to 4 weight % of the composition.

The invention further provides a lubricant composition which includes at least 50 weight % of a Group II base oil, a Group III base oil, or mixtures thereof.

DETAILED DESCRIPTION

Various preferred features and embodiments will be described below by way of non-limiting illustration.

The disclosed technology provides a zinc-free lubricating composition, a method for lubricating an internal combustion engine with a zinc-free lubricating composition, and the use as disclosed above.

It is understood that low levels of metal may be carried into the lubricant composition from various synthetic and catalytic synthetic pathways; low levels of metal of this type, i.e., less than 100 ppm total metal content, are intended to be within the scope of a "metal free" composition. By "zinc free" or "metal free" it is intended that zinc and other metals are not purposefully added to the composition.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Publication 2010/0197536, see [0072] to [0073]). A more detailed description of natural and synthetic lubricating oils is described in paragraphs [0058] to [0059] respectively of WO2008/147704 (a similar disclosure is provided in US Patent Publication 2010/0197536, see [0075] to [0076]). Synthetic oils may also be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the April 2008 version of "Appendix E—API Base Oil Interchangeability Guidelines for Passenger Car Motor Oils and Diesel Engine Oils", section 1.3 Subheading 1.3. "Base Stock Categories". The API Guidelines are also summarized in U.S. Pat. No. 7,285,516 (see column 11, line 64 to column 12, line 10). In one embodiment, the oil of lubricating viscosity may be an API Group II, Group III, or Group IV oil, or mixtures thereof. The five base oil groups are as follows:

| Base Oil Category | Sulfur (%) | Saturates (%) | Viscosity Index |
|---|---|---|---|
| Group I | >0.03 and/or | <90 | 80 to 120 |
| Group II | ≤0.03 and | ≥90 | 80 to 120 |
| Group III | ≤0.03 and | ≥90 | ≥120 |
| Group IV | All polyalphaolefins (PAO) | | |
| Group V | All others not included in Groups I, II, III, or IV | | |

The amount of the oil of lubricating viscosity present is typically the balance remaining after subtracting from 100 weight % (wt %) the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of these additives to the oil of lubricating viscosity and/or to diluent oil include the ranges of 1:99 to 99:1 by weight, or 80:20 to 10:90 by weight.

In one embodiment, the base oil has a kinematic viscosity at 100° C. from 2 $mm^2/s$ (centiStokes—cSt) to 16 $mm^2/s$, from 3 $mm^2/s$ to 10 $mm^2/s$, or even from 4 $mm^2/s$ to 8 $mm^2/s$.

The ability of a base oil to act as a solvent (i.e. solvency) may be a contributing factor in increasing the frequency of low-speed pre-ignition events during operation of a direct fuel-injected engine. Base oil solvency may be measured as the ability of an un-additized base oil to act as a solvent for polar constituents. In general, base oil solvency decreases as the base oil group moves from Group I to Group IV (PAO). That is, solvency of base oil may be ranked as follows for oil of a given kinematic viscosity: Group I>Group II>Group III>Group IV. Base oil solvency also decreases as the viscosity increases within a base oil group; base oil of low viscosity tends to have better solvency than similar base oil of higher viscosity. Base oil solvency may be measured by aniline point (ASTM D611).

In one embodiment, the base oil comprises at least 30 wt % of Group II or Group III base oil. In another embodiment, the base oil comprises at least 60 weight % of Group II or Group III base oil, or at least 80 wt % of Group II or Group III base oil. In one embodiment, the lubricant composition comprises less than 20 wt % of Group IV (i.e. polyalphaolefin) base oil. In another embodiment, the base oil comprises less than 10 wt % of Group IV base oil. In one embodiment, the lubricating composition is substantially free of (i.e. contains less than 0.5 wt %) of Group IV base oil.

Ester base fluids, which are characterized as Group V oils, have high levels of solvency as a result of their polar nature. Addition of low levels (typically less than 10 wt %) of ester to a lubricating composition may significantly increase the resulting solvency of the base oil mixture. Esters may be broadly grouped into two categories: synthetic and natural. An ester base fluid would have a kinematic viscosity at 100° C. suitable for use in an engine oil lubricant, such as between 2 cSt and 30 cSt, or from 3 cSt to 20 cSt, or even from 4 cSt to 12 cSt.

Synthetic esters may comprise esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with any of variety of monohydric alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Other synthetic esters include those made from C5 to C12 monocarboxylic acids and polyols and polyol ethers such as neopentyl glycol, trimethylolpropane, pentaerythritol, dipentaerythritol, and tripentaerythritol. Esters can also be monoesters of monocarboxylic acids and monohydric alcohols.

Natural (or bio-derived) esters refer to materials derived from a renewable biological resource, organism, or entity, distinct from materials derived from petroleum or equivalent raw materials. Natural esters include fatty acid triglycerides, hydrolyzed or partially hydrolyzed triglycerides, or transesterified triglyceride esters, such as fatty acid methyl ester (or FAME). Suitable triglycerides include, but are not limited to, palm oil, soybean oil, sunflower oil, rapeseed oil, olive oil, linseed oil, and related materials. Other sources of triglycerides include, but are not limited to, algae, animal tallow, and zooplankton. Methods for producing bio lubricants from natural triglycerides are described in, e.g., United States Patent Publication 2011/0009300A1.

In one embodiment, the lubricating composition comprises at least 2 wt % of an ester base fluid. In one embodiment the lubricating composition of the invention comprises at least 4 wt % of an ester base fluid, or at least 7 wt % of an ester base fluid, or even at least 10 wt % of an ester base fluid.

Phosphorus Anti-Wear Agent

The zinc-free phosphorus anti-wear agent may contain sulfur or may be sulfur-free. Sulfur-free phosphorus-containing antiwear agents may be phosphites, phosphonates, alkylphosphate esters, amine or ammonium phosphate salts, or mixtures thereof. The phosphorus antiwear agent may be present at 0 wt % to 3 wt %, or 0.1 wt % to 1.5 wt %, or 0.5 wt % to 0.9 wt %, or 0.8 wt % to 2.0 wt % of the lubricating composition.

Phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Amine phosphates may be amine salts of (i) monohydrocarbylphosphoric acid, (ii) dihydrocarbylphosphoric acid, (iii) hydroxy-substituted di-ester of phosphoric acid, or (iv) phosphorylated hydroxy-substituted di- or tri-ester of phosphoric acid. The amine salt of a sulfur-free phosphorus-containing compound may be salts of primary amines, secondary amines, tertiary amines, or mixtures thereof.

Amine phosphate salts may be derived from mono- or di-hydrocarbyl phosphoric acid (typically alkyl phosphoric acid), or mixtures thereof. The alkyl of the mono- or di-hydrocarbyl phosphoric acid may comprise linear or branched alkyl groups of 3 to 36 carbon atoms. The hydrocarbyl group of the linear or branched hydrocarbylphosphoric acid may contain 4 to 30, or 8 to 20 carbon atoms. Examples of a suitable hydrocarbyl group of the hydrocarbyl phosphoric acid may include isopropyl, n-butyl, sec-butyl, amyl, 4-methyl-2-pentyl (i.e., methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the phosphate is a mixture of mono- and di-(2-ethylhexyl)phosphate.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

In one embodiment, the amine salt of a phosphoric acid is derived from beta-, gamma-, or delta-amino ester compound, or mixtures thereof. The substituted γ-aminoester may be generally depicted as a material represented by the formula

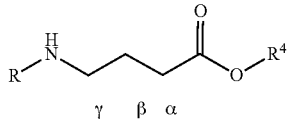

where R may be the hydrocarbyl substituent and $R^4$ may be the residue of the alcohol from which the ester may be envisioned as having been prepared by condensation of an amino acid with an alcohol. If the material may be a thioester, the —$OR^4$ group may be replaced by an —$SR^4$ group. Such a material may be envisioned as derived from the condensation of an acid or acid halide with an appropriate mercaptan $R^4SH$, although in practice it may be prepared by transesterification of an ester with a mercaptan. In one embodiment, hydrocarbyl group (R) may be selected such that there is a substituent at the 1 or 2 (that is, α or β-position of the hydrocarbyl chain.

In one embodiment, the amine phosphate may be derived from aromatic amines, i.e., amines substituted with one or more aryl groups. The aryl groups may be substituted, unsubstituted, or combinations thereof. The aryl groups may be substituted with hydrocarbyl groups, acyl groups, hydroxy groups, alkoxy groups, and combinations thereof. Examples of suitable aromatic amines include anilines, diphenylamines, phenylene diamines, and derivatives thereof.

In one embodiment, the aromatic amine phosphate is a phosphate salt of an aniline compound represented by the formula

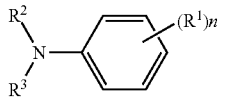

where n=0, 1, or 2; each $R^1$ is independently selected from a hydrocarbyl group of 1 to 20 carbon atoms, —C(=O)$XR^4$, —$OR^5$, or combinations thereof; $R^2$ and $R^3$ are independently hydrogen or an aliphatic hydrocarbyl group of 1 to 12 carbon atoms; X is oxygen or —$NR^6$—; $R^4$ is selected from a hydrocarbyl group of 1 to 24 carbon atoms, a (poly)ether group according to the formula —$(CH_2CHR^7O)_m$—$R^8$, or combinations thereof; $R^5$ is hydrogen, a hydrocarbyl group of 1 to 24 carbon atoms, a (poly)ether group according to the formula —$(CH_2CHR^7O)_m$—$R^8$; $R^6$ is hydrogen or a hydrocarbyl group of 1 to 12 carbon atoms; m is an integer from 1 to 20; each $R^7$ is independently hydrogen, a hydrocarbyl group of 1 to 20 carbon atoms, or combinations thereof; and R8 is hydrogen or a hydrocarbyl group of 1 to 24 carbon atoms. Suitable aniline compounds include N,N-dihydrocarbylanilines, such as N,N-di(hexyl)aniline; hydrocarbyl esters of anthranilic acid, such as methyl-, ethyl-, propyl-, butyl-, hexyl-, octyl, iso-octyl, 2-ethylhexyl, decyl-, isodecyl-, dodecyl-, tridecyl-, isotridecyl, hexadecyl-, oleyl, stearyl-esters and combinations thereof; and alkoxy-substituted anilines, such as p-anisidine, p-ethoxyaniline, and N,N-di(2-ethylhexyl)-p-ethoxyaniline.

In one embodiment, the aromatic amine phosphate is a phosphate salt of a diaryl amine compound represented by the formula

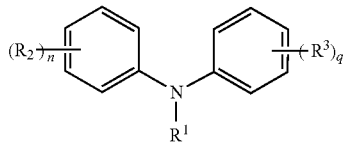

where $R^1$ is selected from hydrogen, a hydrocarbyl group of 1 to 24 carbon atoms, an acyl-containing group according to the formula —$CH_2CH_2$(C=O)$OR^4$, an alkoxylate according to the formula —$(CH_2CHR^5O)_m$—$R_6$, or combinations thereof; $R^2$ and $R^3$ are each independently hydrocarbyl groups of 4 to 18 carbon atoms; each n and q is independently 0, 1, or 2; $R^4$ is a hydrocarbyl group of 1 to 18 carbon atoms; each $R^5$ is independently hydrogen or a hydrocarbyl group of 1 to 18 carbon atoms; $R^6$ is hydrogen or a hydrocarbyl group of 1 to 18 carbon atoms; and m is an integer from 1 to 20. When either n or q is 2 and the two hydrocarbyl groups ($R^2$ or $R^3$ as applicable) are on adjacent carbons of the ring, they may be taken together to form 5- or 6-membered rings that may be saturated, unsaturated, or aromatic. Suitable diaryl amine compounds include diphenylamine, phenyl-α-naphthylamine, alkylated diphenylamine, alkylated phenyl-α-naphthylamine, and combinations thereof. Alkylated diarylamines may have one, two, three, or even four alkyl groups; alkyl groups may be branched or linear and contain 4 to 18 carbon atoms, 6 to 12 carbon atoms, or 8 to 10 carbon atoms.

In one embodiment, the aromatic amine phosphate is a phosphate salt of a phenylene diamine compound represented by the formula

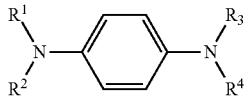

where $R^1$, $R^2$, $R^3$, and $R^4$ are each independently hydrogen, or a hydrocarbyl group of 1 to 24 carbon atoms, and wherein at least one of $R^1$, $R^2$, $R^3$, and $R^4$ is not a hydrogen atom. Examples of suitable phenylene diamine compounds include N,N,N'N'-tetrapentyl-phenylenediamine, and N,N'-di(2-ethylhexyl)-N,N'-di(sec-butyl)-phenylenediamine.

In one embodiment, the zinc-free phosphorus anti-wear agent may be selected from phosphites, phosphonates, alkylphosphate esters, amine or ammonium phosphate salts, or mixtures thereof and is present in the lubricant composition in amount 0.01 to 5 percent by weight of the composition, or 0.1 to 3.2 weight percent of the composition, or 0.35 to 1.8 weight percent of the composition. In one embodiment, the zinc-free phosphorus anti-wear agent may be present in an amount to provide 0.01 weight percent to 0.15 weight percent phosphorus, or 0.025 to 0.085 weight percent phosphorus, or 0.025 to 0.065 weight percent phosphorus to the composition.

Ashless Detergent

The ashless (or metal-free) detergent may comprise a basic salt of a quaternary pnictogen compound. By basic salt, it is meant that the quaternary pnictogen compound provides base number (measured as total base number TBN by ASTM D2896 and/or ASTM D4739) to the lubricating composition.

The ashless detergents of the present technology differ from conventional metal-based detergents in that they are metal free or substantially metal free or contain a lower amount of metal that would be expected based on the amount of TBN that they deliver. Alternatively expressed, they do not contribute metal ions to lubricants in which they are added or contribute less metal ions than would be expected on the amount of TBN that they deliver. In certain embodiments, the detergents are metal free, although they may be mixed with other components, such as other detergents that do contain metal, while still, in themselves, being metal free. By the term "substantially metal free" is meant a detergent that contains only a contaminant or a trace amount of a metal, an amount that may in many circumstances be ignored. For instance, such a detergent may contain less than 5% or less than 3 or 1% metal by weight.

In place of some or all of the metal ion of the detergent, the materials of the present invention will contain one or more quaternary non-metallic pnictogen cations. Pnictogens are the elements in column 15 (or Group Va) of the periodic table, the column headed by nitrogen. The non-metallic pnictogens include nitrogen and phosphorus.

Quaternary nitrogen or phosphorus compounds are known. Ordinarily nitrogen is a trivalent element, forming three covalent bonds to hydrogen or carbon atoms in ammonia or amines: $NH_xR_{3-x}$, where R is a group linked to the nitrogen atom through a carbon atom of the R group. Quaternary nitrogen compounds, on the other hand, comprise a quaternary ammonium ion and a counterion (e.g., hydroxide, halide), represented by the general formula $$NR_4^+X^-$$

where, each R independently represents a suitable hydrocarbyl group, and $X^-$ represents one equivalent of an anionic counterion, which may include fractional equivalents of polyanionic species (e.g. a half mole of carbonate, i.e., ½ $CO^{2-}$). Quaternary phosphonium ions may be similarly represented (PRO. In such materials, the nitrogen (or phosphorus) has four substantially non-ionizable covalent bonds to carbon atoms. The quaternary atoms are permanently charged and are comparatively unaffected by the pH of the medium. They are thus distinguished from ordinary ammonium or phosphonium ions or protonated amines, which materials contain up to three substantially non-ionizable covalent bonds to carbon and one or more acidic hydrogen atoms or protons associated with the nitrogen or phosphorus atom. The present quaternary ions will not contribute acidity to the detergent, as would be titratable as TAN by ASTM D 664A. The basic ashless detergents of the present technology will thus be free from acidic protons in the sense that they will have the general structure $NR_4^+X^-$ rather than $HNR_3^+X^-$, in the case of nitrogen. However, the detergent molecules overall may (or may not) contain other acidic hydrogen that is titratable as TAN, on other portions of the detergent than the cation, that is, on the anionic substrate portion. An example of a titratable hydrogen might be on a phenolic OH group or bicarbonate ($HCO_3^-$). In certain embodiments, however, the detergent as a whole will be substantially free from acidic protons, having a TAN of less than 10 or less than 5 or less than 3 or less than 1, on an oil free basis.

It is not intended that each of the four bonds of the nitrogen or phosphorus must necessarily be directed to a separate carbon atom: The 4 R groups are not necessarily different carbon groups. Thus, two of the bonds may be directed to the same carbon atom in a double-bonded structure or as delocalized bonds within an aromatic ring. Examples of such include pyridinium ions and imidazolium ions.

Many quaternary salt compounds are known. Quaternary ammonium salts, for instance, are commercially available and may be prepared by the reaction of ammonia or an amine with an alkyl halide as the complete alkylation product, Certain quaternary phosphonium salts may be prepared by the reaction of phosphine with aldehydes, e.g., tetrakis(hydroxymethyl)phosphonium chloride. Examples of quaternary ammonium compounds include tetrahydrocarbyl ammonium salts with hydrocarbyl groups such as methyl, ethyl, propyl, butyl, benzyl, and mixtures thereof. In another embodiment, up to three of the R groups in the quaternary $NR_4^+$ structure may be such hydrocarbyl groups and one or more groups may be a hydroxy-substituted hydrocarbyl group such as a hydroxyalkyl group, or an amine-substituted hydrocarbyl group. Examples of quaternary ammonium salts containing a hydroxyalkyl group, and methods for their synthesis, are disclosed in U.S. Pat. No. 3,962,104, Swietlik et al.; see column 1 line 16 through column 2 line 49; column 8 lines 13 through 49, and the Examples. In certain embodiments, the quaternary ammonium compound is derived from a monoamine, i.e., a tertiary amine having only a single amino group, i.e., having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. Further examples of quaternary ammonium compounds include tetraethylammonium hydroxide or halide and tetrabutylammonium hydroxide or halide and such biological materials as choline chloride, $HOCH_2CH_2N(CH_3)_3Cl$. Any such materials may provide the cation for the present detergents.

The anion portion of the detergent may be an organic anion having at least one aliphatic hydrocarbyl group of sufficient length to impart oil solubility to the detergent. Suitable aliphatic hydrocarbyl groups, if they are in the form of a substituent on an aromatic ring (as in alkylphenates or alkylbenzenesulfonates) may contain 4 to 400 carbon atoms, or 6 to 80 or 6 to 30 or 8 to 25 or 8 to 15 carbon atoms. The anionic portion of the detergent may thus be any of the anions derived from the acidic organic materials that are used to prepare conventional detergents. As mentioned above, these include sulfonic acids, providing sulfonate detergents with sulfonate anions, carboxylic acids, providing carboxylate detergents with carboxylate anions, phenols, providing phenate detergents with phenate anions, hydrocarbyl-substituted salicylic acids, providing salicylate detergents with salicylate anions, phosphonic acids, providing phosphonate detergents, as well as salixarate, calixarate, and saligenin detergents, and mixtures thereof. In certain embodiments, the ashless detergents may be sulfonates or salicylates, and in other embodiments, sulfonates.

The anion portion of the ashless detergent may be an acylated (co)polymer. Acylated (co)polymers include (co)

polymers containing or functionalized with at least one carboxylic acid group, carboxylic anhydride, or mixtures thereof. Acylated polymers include polyolefins that have been grafted or otherwise functionalized with one or more α,β-unsaturated acylating agents. Suitable polyolefins include (co)polymers of ethylene, propylene, butene, isobutylene, higher alpha-olefins, butadiene, isoprene, and combinations thereof. In one embodiment, the acylated copolymer is a polyisobutylene having a number average molecular weight (Mn) of 400 to 3000 (as measured versus polystyrene standards) functionalized with at least 1 and up to 2 succinic acid groups or functional equivalents (e.g., succinic anhydride). In one embodiment, the acylated copolymer is a copolymer of ethylene and at least one higher alpha olefin, wherein the olefin copolymer has Mn of between 5000 Daltons and 100,000 Daltons or between 15,000 Daltons and 60,000 Daltons (as measured by GPC against polystyrene standards). In one embodiment, the acylated copolymer is a copolymer of ethylene and propylene; a copolymer of ethylene, propylene and butene; a copolymer of ethylene and butene; or combinations thereof.

The acylated copolymer may be a poly(meth)acrylate (PMA) containing at least one of (meth)acrylic acid moieties, other acylated monomers that copolymerize readily with (meth)acrylates, or combinations thereof. In one embodiment, the poly(meth)acrylate contains at least 2 weight percent (meth)acrylic acid moiety, either by direct incorporation of (meth)acrylic acid monomers during polymerization or by partial hydrolysis of the polymethacrylate after polymerization is complete. PMA's are prepared from mixtures of methacrylate monomers having different alkyl groups. The alkyl groups may be either straight chain or branched chain groups containing from 1 to 24 carbon atoms. Other acylated monomers that may co-polymerize with (meth)acrylates include maleic acid, maleic anhydride, fumaric acid, cinnamic acid, caffeic acid, esters of the preceding acids, and combinations thereof.

The anion portion of the ashless detergent may further include an inorganic anion, especially the conjugate base of inorganic protic acids. Inorganic anions include borate, sulfate, phosphate, nitrate, carbonate, bicarbonate, hydroxide, and combinations thereof. In one embodiment, the ashless detergent comprises a quaternary pnictogen salt of an inorganic base such as carbonate, bicarbonate, hydroxide, or mixtures thereof.

The ashless quaternary pnictogen detergent may be a mixture of both organic and inorganic anions salts; that is, the quaternary pnictogen cation would be present in excess of the amount necessary to effect a stoichiometric neutral salt with the organic anion. In such cases, the ashless detergent may be understood to be overbased. Degree of overbasing (or "base ratio") can be calculated as the ratio of cation equivalents (herein described as a quaternary pnictogen cation) to organic anion equivalents; a neutral salt of [tetraalkylammonium] [alkylbenzenesulfonate] can be seen as having a base ratio of 1.0. In one embodiment, the ashless detergent comprising a quaternary pnictogen salt of an organic anion is overbased. The ashless detergents of the present invention may thus, in certain embodiments, have a base ratio of 1.1, 1.5 or 2 or 3 or 7, up to 40 or 25 or 20 or 10.

Overbased ashless detergents may be obtained by a process analogous to the process for preparing overbased metal-containing detergents, while considering the important differences required to obtain the present materials. That is, the present detergents may be prepared by reacting a mixture comprising an acidic organic compound or substrate, as described above, with a molar excess, that is, a stoichiometric excess, of a basic quaternary pnictogen compound, optionally in an inert reaction medium or organic solvent such as mineral oil, naphtha, toluene, or xylene. Optionally, an additional acidic material may be present, such as oxo acid, e.g., carbon dioxide, to form a carbonate or bicarbonate, and optionally a small amount of a promoter (e.g., an alkanol of one to twelve or one to six carbon atoms such as methanol, ethanol, or amyl alcohol, or an alkylated an alkylated phenol such as heptylphenol, octylphenol, or nonylphenols) may be present.

The presence of the oxo acid may assist in incorporation of larger quantities of base, through formation of, in the case of carbon dioxide, colloidal carbonate of the base. Suitable oxo anions which may become a part of the overbased detergent include carbonate, bicarbonate, borate, hydroxide, nitrate, phosphate, sulfate, and carboxylate, such as oxalate, tartrate, citrate, succinate, and acetate ions. The carboxylate anions may contain 8 or fewer or 6 or fewer or 5 or fewer or 3 or 2 or 1 carbon atom(s). Also included may be ions derived from β-keto esters and diketones. The oxo anions may be derived from inorganic acids, e.g., carbonate or bicarbonate ions.

In one embodiment, the ashless detergent may at least one of an alkylbenzene sulfonate detergent, a phenate detergent, a sulfur-coupled detergent, a salicylate detergent, an aliphatic carboxylic acid detergent, overbased compositions of said detergents, or mixtures thereof.

The ashless detergent may have a TBN of at least 35 mg KOH/g as measured by ASTM D2896. In one embodiment the ashless detergent may have a TBN of at least 50 mg KOH/g, or at least 75 mg KOH/g, or at least 95 mg KOH/g (reported on an oil-free basis, i.e., excluding any diluent oil).

The ashless detergent may be present in the lubricating composition in an amount 0.1 to 10 weight percent of the composition, or 0.5 to 5 weight percent of the composition, or even 0.8 to 3.2, or 1.4 to 3.2, or 1.8 to 3.2 weight percent of the composition. In some embodiments, the ashless quaternary pnictogen detergent may be present in the lubricating composition in amount to deliver total base number (TBN) at least 1.5 mg KOH/g to the composition, or at least 2.3, or 3.0 up to 12, or even 4.4 up to 8.5, or even 5.0 to 7.0 mg KOH/g to the lubricating composition (as measured by ASTM D2896).

Ashless Antioxidant

Ashless antioxidants may comprise one or more of arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The diarylamine antioxidant of the invention may be present on a weight basis of this lubrication composition at 0.1% to 10%, 0.35% to 5%, or even 0.5% to 2%.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or butyl 3-(3,5-ditert-butyl-4-hydroxyphenyl)propanoate. In one embodiment, the hindered phenol antioxidant may be an ester and may include, e.g., Irganox™ L-135 from Ciba.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Phenols of the invention also include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one embodiment, the phenolic antioxidant comprises a hindered phenol. In another embodiment the hindered phenol is derived from 2,6-ditertbutyl phenol.

In one embodiment, the lubricating composition of the invention comprises a phenolic antioxidant in a range of 0.01 wt % to 5 wt %, or 0.1 wt % to 4 wt %, or 0.2 wt % to 3 wt %, or 0.5 wt % to 2 wt % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2.

Ashless antioxidants may be used separately or in combination. In one embodiment of the invention, two or more different antioxidants are used in combination, such that there is at least 0.1 weight percent of each of the at least two antioxidants and wherein the combined amount of the ashless antioxidants is 0.5 to 5 weight percent. In one embodiment, there may be at least 0.25 to 3 weight percent of each ashless antioxidant.

Other Performance Additives

The compositions of the invention may optionally comprise one or more additional performance additives. These additional performance additives may include one or more metal deactivators, viscosity modifiers, friction modifiers, antiwear agents other than the phosphorus additive of the invention, corrosion inhibitors, dispersants, dispersant viscosity modifiers, extreme pressure agents, metal-containing detergents, foam inhibitors, demulsifiers, pour point depressants, seal swelling agents, and any combination or mixture thereof. Typically, fully-formulated lubricating oil will contain one or more of these performance additives, and often a package of multiple performance additives.

Suitable dispersants for use in the compositions of the present invention include polyalkenyl succinimide dispersants. In one embodiment, the dispersant may be present as a single dispersant. In one embodiment, the dispersant may be present as a mixture of two or three different dispersants, wherein at least one may be a polyalkenyl succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment, the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent 0 355 895B1.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment, the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalized polyolefins, for example, ethylene-propylene copolymers that have been functionalized with an acylating agent such as maleic anhydride and an amine. In one particular embodiment, the dispersant viscosity modifier comprises an olefin copolymer further functionalized with a dispersant amine group. Typically, the olefin copolymer is an ethylene-propylene copolymer. The olefin copolymer has a number average molecular weight of 5000 to 20,000, or 6000 to 18,000, or 7000 to 15,000. The olefin copolymer may have a shear stability index of 0 to 20, or 0 to 10, or 0 to 5 as measured by the Orbahn shear test (ASTM D6278).

The formation of a dispersant viscosity modifier is well known in the art. The dispersant viscosity modifier may include for instance those described in U.S. Pat. No. 7,790,661 column 2, line 48 to column 10, line 38. In one embodiment, the dispersant viscosity modifier may be prepared by grafting of an olefinic carboxylic acid acylating agent onto a polymer of 15 to 80 mole percent of ethylene, from 20 to 85 mole percent of C3-10α-monoolefin, and from 0 to 15 mole percent of non-conjugated diene or triene, said polymer having an average molecular weight ranging from 5000 to 20,000, and further reacting said grafted polymer with an amine (typically an aromatic amine).

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. Suitable amines may be aliphatic or aromatic amines and polyamines. Examples of suitable aromatic amines include nitroaniline, aminodiphenylamine (ADPA), hydrocarbylene coupled polyaromatic amines, and mixtures thereof. More detailed description of dispersant viscosity modifiers are disclosed in International Publication WO2006/015130 or U.S. Pat. Nos. 4,863,623; 6,107,257; 6,107,258; 6,117,825; and 7,790,661.

In one embodiment, the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment, the dispersant viscosity modifier may include those described in U.S. Pat. No. 7,790,661 column 2, line 48 to column 10, line 38.

In one embodiment, the invention provides a lubricating composition which further includes an antiwear agent different from the zinc-free phosphorus antiwear agent described above. Examples of suitable antiwear agents include titanium compounds, hydroxy-carboxylic acid derivatives such as esters, amides, imides or amine or ammonium salt, ssulfurised olefins, thiocarbamate-containing compounds, such as thiocarbamate esters, thiocarbamate amides, thiocarbamic ethers, alkylene-coupled thiocarbamates, and bis(S-alkyldithiocarbamyl) disulfides. Suitable hydroxy-carboxylic acid derivatives include tartaric acid derivatives, malic acid derivatives, citric acid derivatives, glycolic acid derivatives, lactic acid derivatives, and mandelic acid derivatives.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

In one embodiment, the lubricant composition comprising (a) an oil of lubricating viscosity; (b) a zinc-free phosphorous-containing anti-wear agent; (c) at least one ashless detergent comprising a basic quaternary pnictogen salt (typically chosen from a hydroxide, carbonate, or bicarbonate); and (d) an ashless antioxidant, wherein the lubricating composition is free or substantially free of metal (typically 0 ppm to 250 ppm, or 0 to 100 ppm or 0 to 50 ppm of metal, or 0 ppm of metal by weight), wherein the ashless detergent has a total acid number (TAN) of less than 5 mg KOH/g as measured by ASTM D664, further comprises 0.01 to 5 wt % or 0.1 to 2 wt % of an ashless antiwear agent represented by Formula:

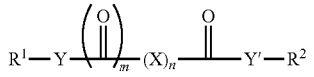

wherein Y and Y' are independently —O—, >NH, >$NR^3$, or an imide group formed by taking together both Y and Y' groups and forming a $R^1$—N< group between two >C=O groups; X is independently —Z—O—Z'—, >$CH_2$, >$CHR^4$, >$CR^4R^5$, >C(OH)($CO_2R^2$), >C($CO_2R^2$)$_2$, or >$CHOR^6$; Z and Z' are independently >$CH_2$, >$CHR^4$, >$CR^4R^5$, >C(OH)($CO_2R^2$), or >$CHOR^6$; n is 0 to 10, with the proviso that when n=1, X is not >$CH_2$, and when n=2, both X's are not >$CH_2$; m is 0 or 1; $R^1$ is independently hydrogen or a hydrocarbyl group, typically containing 1 to 150 carbon atoms, with the proviso that when $R^1$ is hydrogen, m is 0, and n is more than or equal to 1; $R^2$ is a hydrocarbyl group, typically containing 1 to 150 carbon atoms; $R^3$, $R^4$ and $R^5$ are independently hydrocarbyl groups; and $R^6$ is hydrogen or a hydrocarbyl group, typically containing 1 to 150 carbon atoms.

The ashless phosphorus-free antiwear agent may be present at 0 wt % to 3 wt %, or 0.1 wt % to 1.5 wt %, or 0.5 wt % to 1.1 wt % of the lubricating composition.

In one embodiment, the invention provides a lubricating composition further comprising a friction modifier. Examples of friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. The term fatty, as used herein, can mean having a C8-22 linear alkyl group.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment, the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment, the friction modifier may be a long chain fatty acid ester. In another embodiment the long chain fatty acid ester may be a mono-ester or a diester or a mixture thereof, and in another embodiment, the long chain fatty acid ester may be a triglyceride.

In one embodiment, the lubricating composition further comprises a metal-containing overbased detergent. Metal overbased detergents, otherwise referred to as over-based detergents, metal-containing overbased detergents or super-based salts, are characterized by a metal content in excess of that which would be necessary for neutralization according to the stoichiometry of the metal and the particular acidic organic compound, i.e., the substrate, reacted with the metal. The overbased detergent may comprise one or more of non-sulfur containing phenates, sulfur containing phenates, hydrocarbylsulfonates, salicylates, and mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased detergent of the invention may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g., phenate-salicylates, sulfonate-phenates, sulfonate-salicylates, sulfonates-phenates-salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 450 TBN. Overbased sulfonates typically have a total base number of 250 to 600, or 300 to 500. Overbased detergents are known in the art.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) p-dodecylphenol. In one embodiment, the lubricating composition of the invention contains less than 0.3 weight percent of alkylphenol, less than 0.1 weight percent of alkylphenol, or less than 0.05 weight percent of alkylphenol.

In one embodiment, the sulfonate detergent may be predominantly a linear alkylbenzene sulfonate detergent having a metal ratio of at least 8 as is described in paragraphs [0026] to [0037] of US Patent Publication 2005/065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Salicylate detergents and overbased salicylate detergents may be prepared in at least two different manners. Carbonylation (also referred to as carboxylation) of a p-alkylphenol is described in many references including U.S. Pat. No. 8,399,388. Carbonylation may be followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing, as described in U.S. Pat. No. 7,009,072. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms. In one embodiment, the overbased detergent of the invention is a salicylate detergent. In one embodiment, the salicylate detergent of the invention is free of unreacted p-alkylphenol (i.e., contains less than 0.1 weight percent). In one embodiment, the salicylate detergent of the invention is prepared by alkylation of salicylic acid.

The metal-containing overbased detergents may be present at 0 wt % to 2 wt %, or 0.01 wt % to 1 wt %, or 0.1 wt % to 0.5 wt %.

Metal-containing detergents contribute sulfated ash to a lubricating composition. Sulfated ash may be determined by ASTM D874. In one embodiment, the lubricating composition of the invention comprises a metal-containing detergent in an amount to deliver at no more than 0.4 weight percent sulfated ash to the total composition. In another embodiment, the metal-containing detergent is present in an amount to deliver at least 0.05 weight percent sulfated ash, or at least 0.1 weight percent sulfated ash, or even at least 0.15 weight percent sulfated ash to the lubricating composition. In one embodiment, the metal-containing overbased detergent is present in an amount to deliver 0.01 weight percent to 0.2 weight percent sulfated ash to the lubricating composition. In one embodiment, the lubricating composition contains less than 0.1 weight percent sulfated ash from a metal-containing detergent, or less than 0.05 weight percent ash from a metal-containing detergent. In one embodiment, the lubricating composition is substantially free of sulfated ash from a metal-containing overbased detergent.

In addition to ash and TBN, overbased detergents contribute detergent soap, also referred to as neutral detergent salt, to the lubricating composition. Soap, being a metal salt of the substrate, may act as a surfactant in the lubricating composition. In one embodiment, the lubricating composition comprises 0.05 weight percent to 1.5 weight percent detergent soap, or 0.1 weight percent to 0.9 weight percent detergent soap. In one embodiment, the lubricating composition contains no more than 0.5 weight percent detergent soap. The overbased detergent may have a weight ratio of ash to soap of 5:1 to 1:2.3, or 3.5:1 to 1:2, or 2.9:1 to 1:1:7.

In one embodiment, the lubricant composition comprises less than 0.1 weight percent of a metal-containing detergent, or less than 0.05 weight percent of a metal containing detergent. In one embodiment, the lubricant composition is free of a metal-containing detergent, i.e., the composition contains less than 50 ppm metal, or less than 25 ppm metal, or 0 ppm metal intentionally added from a detergent.

Other performance additives such as corrosion inhibitors include those described in paragraphs 5 to 8 of US Application U.S. Ser. No. 05/038,319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides.

Pour point depressants that may be useful in the compositions of the invention further include polyalphaolefins, esters of maleic anhydride-styrene, poly(meth)acrylates, polyacrylates or polyacrylamides.

The viscosity modifier is known in the art and may include hydrogenated styrene-butadiene rubbers, ethylene-propylene copolymers, ethylene copolymers with propylene and higher olefins, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof. The viscosity modifier may include a block copolymer comprising (i) a vinyl aromatic monomer block and (ii), a conjugated diene olefin monomer block (such as a hydrogenated styrene-butadiene copolymer or a hydrogenated styrene-isoprene copolymer), a polymethacrylate, an ethylene-alpha olefin copolymer, a hydrogenated star polymer comprising conjugated diene monomers such as butadiene or isoprene, or a star polymer of polymethacrylate, or mixtures thereof.

In different embodiments, the lubricating composition may have a composition as described in the following table:

| | Embodiments (wt %) | | |
|---|---|---|---|
| Additive | A | B | C |
| Phosphorus anti-wear agent | 0.01 to 4 | 0.1 to 2.5 | 0.3 to 1.8 |
| Antioxidant | 0.05 to 1 | 0.2 to 3 | 0.5 to 2.5 |
| Ashless Detergent | 0.1 to 10 | 0.5 to 5 | 0.75 to 3.2 |
| Dispersant | 0.05 to 12 | 0.75 to 8 | 0.5 to 6 |
| Dispersant Viscosity Modifier | 0 or 0.05 to 5 | 0 or 0.05 to 4 | 0.05 to 2 |
| Additional Overbased Detergent | 0 or 0.01 to 2 | 0.01 to 1.0 | 0 to 0.2 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | Balance to 100% | Balance to 100% | Balance to 100% |

The present invention provides a surprising ability to prevent damage to an engine in operation due to pre-ignition events resulting from direct gasoline injection into the combustion chamber. This is accomplished while maintaining fuel economy performance, low sulfated ash levels, improved deposit control, and other limitations, required by increasingly stringent government regulations.

INDUSTRIAL APPLICATION

As described above, the invention provides for a method of lubricating an internal combustion engine comprising supplying to the internal combustion engine a lubricating composition as disclosed herein. Generally, the lubricant is added to the lubricating system of the internal combustion engine, which then delivers the lubricating composition to the critical parts of the engine, during its operation, that require lubrication.

The lubricating compositions described above may be utilized in an internal combustion engine. The engine components may have a surface of steel or aluminum (typically a surface of steel) and may also be coated for example with a diamond-like carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may be fitted with an emission control system or a turbocharger. Examples of the emission control system include diesel particulate filters (DPF), or systems employing selective catalytic reduction (SCR).

The internal combustion engine of the present invention is distinct from a gas turbine. In an internal combustion engine, individual combustion events translate from a linear reciprocating force into a rotational torque through the rod and crankshaft. In contrast, in a gas turbine (which may also be referred to as a jet engine) a continuous combustion process generates a rotational torque continuously without translation and can also develop thrust at the exhaust outlet. These differences in operation conditions of a gas turbine and internal combustion engine result in different operating environments and stresses.

The internal combustion engine may be spark ignited or compression ignited and would utilize fuels appropriate to the ignition sequence. A spark ignited internal combustion engine may be port fuel injected (PFI) or direct injected.

The internal combustion engine may be fueled by a normally liquid or gaseous fuel or combinations thereof. The liquid fuel is normally a liquid at ambient conditions e.g., room temperature (20 to 30° C.). The fuel can be a hydrocarbon fuel, a nonhydrocarbon fuel, or a mixture thereof. The hydrocarbon fuel may be a gasoline as defined by ASTM specification D4814. In an embodiment of the invention, the fuel is a gasoline, and in other embodiments, the fuel is a leaded gasoline, or a nonleaded gasoline.

The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, methyl t-butyl ether, methyl ethyl ketone, transesterified oils and/or fats from plants and animals such as rapeseed methyl ester and soybean methyl ester, and nitromethane. Mixtures of hydrocarbon and nonhydrocarbon fuels can include, for example, gasoline and methanol and/or ethanol. In an embodiment of the invention, the liquid fuel is a mixture of gasoline and ethanol, wherein the ethanol content is at least 5 volume percent of the fuel composition, or at least 10 volume percent of the composition, or at least 15 volume percent, or 15 to 85 volume percent of the composition. In one embodiment, the liquid fuel contains less than 15% by volume ethanol content, less than 10% by volume ethanol content, less than 5% ethanol content by volume, or is substantially free of (i.e., less than 0.5% by volume) of ethanol.

In several embodiments of this invention, the fuel can have a sulfur content on a weight basis that is 5000 ppm or less, 1000 ppm or less, 300 ppm or less, 200 ppm or less, 30 ppm or less, or 10 ppm or less. In another embodiment, the fuel can have a sulfur content on a weight basis of 1 to 100 ppm. In one embodiment, the fuel contains about 0 ppm to about 1000 ppm, about 0 to about 500 ppm, about 0 to about 100 ppm, about 0 to about 50 ppm, about 0 to about 25 ppm, about 0 to about 10 ppm, or about 0 to 5 ppm of alkali metals, alkaline earth metals, transition metals or mixtures thereof. In another embodiment, the fuel contains 1 to 10 ppm by weight of alkali metals, alkaline earth metals, transition metals or mixtures thereof.

The gaseous fuel is normally a gas at ambient conditions e.g., room temperature (20 to 30° C.). Suitable gas fuels include natural gas, liquefied petroleum gas (LPG), compressed natural gas, or mixtures thereof. In one embodiment, the engine is fueled with natural gas.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment, the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

The lubricant composition may be an engine oil having a kinematic viscosity of up to about 32.5 cSt at 100° C., or from about 4.5 to about 18.5 cSt at 100° C., or from about 5.3 to about 13.5 cSt at 100° C., or from about 6 to about 10.5 cSt at 100° C. as measured by ASTM D445.

High temp high shear (HTHS) are viscosity measurements and represent a fluid's resistance to flow under conditions resembling highly-loaded journal bearings in internal combustion engines. The HTHS value of an oil and/or lubricating composition directly correlates to the oil film thickness in a bearing. HTHS values of a fluid may be obtained by using ASTM D4683 at 150° C. The lubricating compositions of this invention may have a HTHS of between 1.8 cP and 3.2 cP, or between 2.3 cP and 2.6 cP.

The lubricant composition may be an engine oil having an SAE Viscosity Grade of XW-YY, where X may be 0, 5, 10, 15 or 20; and YY may be (as appropriate) 8, 16, 20, 30, 40 50 or 60. It is understood that the low temperature grade (W) is lower than the high temperature grade (YY). In one embodiment, the lubricant composition may have a viscosity grade of 0W-8, 0W-16, 0W-20, 5W-20, 5W-30, 5W-40, 5W-50, 5W-60, 10W-20, 10W-30, 10W-40, 10W-50, 15W-20, 15W-30, 15W-40, 15W-50 or 15W-60. In one embodiment, the lubricant composition may have a viscosity grade of 10W-30 or less, 5W-30 or less, or 5W-20 or less.

In one embodiment, the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

EXAMPLES

The invention will be further illustrated by the following examples, which set forth particularly advantageous embodiments. While the examples are provided to illustrate the invention, they are not intended to limit it.

Basic Quaternary Pnictogen Salts

Basic quaternary ammonium salts may be prepared or used as available from manufacturers. The synthesis of numerous ashless quaternary ammonium detergents has been described in detail in U.S. Patent Publication 2012-0101012, incorporated by reference. A series of basic salts are prepared (or acquired) as follows (Table 1).

TABLE 1

Ashless Detergents

| Basic Quat Salt | Quaternary Pnictogen | Organic Substrate (if present) | Basic Anion | Quat: Substrate: Anion[1] | TBN[2] | TAN[3] |
|---|---|---|---|---|---|---|
| Q1 | Tetrabutyl Ammonium (TBA) | Sulfonate[4] | $OH^-$ | 2:1:1 | 98 | 1.5 |
| Q2 | TBA | Sulfonate | $OH^-$ | 3:1:1 | 141 | 0.8 |
| Q3 | TBA | Sulfonate | $CO_3^{2-}$ | 1:1:1 | 103 | 0.7 |
| Q4 | TBA | Iso-stearate | $OH^-$ | 2:1:1 | 118 | 2.6 |
| Q5 | TBA | Iso-stearate | $OH^-$ | 5:1:4 | 140 | 1.5 |
| Q6 | Tetraethyl Ammonium (TEA) | Salicylate[5] | $OH^-$ | 2:1:1 | 101 | 0 |
| Q7 | Benzyltriemthyl Ammonium (BTMA) | Salicylate | — | 1:1:0 | 81 | 0 |
| Q8 | TBA | Salicylate | — | 1:1:0 | 78 | 0.9 |
| Q9 | TBA | Salicylate | — | 2:1:1 | 124 | 0 |
| Q10 | 1-Butyl-3-methyl imidazolium | Salicylate | $OH^-$ | 2:1:1 | 143 | 5 |
| Q11 | Cetylpyridinium | Salicylate | — | 1:1:0 | 84 | 0 |
| Q12 | (2-hydroxyhexadecyl) trimethylammonium | — | $CH_3(CO)O^-$ | 1:0:1 | 154 | 0 |

1. Molar ratio of quaternary ammonium cation, organic substrate (if present), and basic anion (if present)
2. As measured by ASTM D2896; reported on an oil-free basis
3. As measured by ASTM D664A; reported on an oil-free basis
4. $C_{20-24}$ alkylbenzene sulfonate
5. 2-($C_{14-18}$ alkyl)salicylate Lubricating Compositions A series of 5W-20 engine lubricants in Group III base oil of lubricating viscosity are prepared containing the additives described above as well as conventional additives including polymeric viscosity modifier, ashless succinimide dispersant, as well as other performance additives as reported in Table 2. The phosphorus, sulfur and ash contents of each of the examples are also presented in the table in part to show that each example has a similar amount of these materials and so provide a proper comparison between the comparative and invention examples.

TABLE 2

| Lubricating Oil Composition Formulations[1] | | | | | | |
|---|---|---|---|---|---|---|
| | COMP EX1 | INV EX2 | INV EX3 | INV EX4 | INV EX5 | INV EX6 |
| Group III Base Oil | Balance to = 100% | | | | | |
| Ashless Detergent Q1 | | 1 | 1 | 1 | 1 | |
| Ashless Detergent Q2 | | 2 | | | 2 | 2 |
| Ashless Detergent Q5 | | | 2 | | | |
| Ashless Detergent Q10 | | | | 2 | | |
| Ashless Detergent Q12 | | | | | | 0.7 |
| Amine Phosphate[2] | | 1.0 | | 1.0 | | 0.5 |
| Amine phosphate[3] | | | 1.8 | | | |
| Dibutylhydrogen phosphite | | | | | 0.26 | 0.13 |
| Di($C_{16-18}$ alkyl) hydrogen phosphonate | | | | | 0.68 | 0.34 |
| Di-2-ethylhexyltartrate | | 0.75 | 0.75 | 0.75 | 0.5 | 0.5 |
| Hindered phenol AO[4] | 1.4 | 1.4 | 1.4 | 1.4 | 1.4 | 1.4 |
| Diarylamine AO[5] | 0.9 | 0.9 | 0.9 | 0.9 | 0.9 | 0.9 |
| Sulfurized olefin | 0.3 | 0.3 | 0.3 | 0.3 | 0.3 | 0.3 |
| Dispersant[6] | 2.5 | 2.5 | 2.5 | 2.5 | 2.5 | 2.5 |
| Viscosity Improver[7] | 0.9 | 0.9 | 0.9 | 0.9 | 0.9 | 0.9 |
| Ca Sulfonate[8] | 0.9 | 0 | 0 | 0 | 0 | 0 |
| ZDDP | 0.7 | 0 | 0 | 0 | 0 | 0 |
| Additional Additives[9] | 0.2 | 0.2 | 0.2 | 0.2 | 0.2 | 0.2 |
| % Phosphorus | 0.078 | 0.077 | 0.077 | 0.077 | 0.076 | 0.077 |
| % Calcium | 0.18 | 0 | 0 | 0 | 0 | 0 |
| TBN | 6.7 | 6.0 | 6.0 | 6.0 | 6.0 | 6.2 |
| % Ash | 0.75 | 0 | 0 | 0 | 0 | 0 |

1 - All amounts shown above are in weight percent and are on an oil-free basis unless otherwise noted.
2 - Ethylhexylamine salt of mixed mono- and di-(isooctyl)phosphate
3 - Salt of dibutyl 2-(((α-methylbenzyl)amino)methyl)succinate and di(2-ethylhexyl)phosphate
4 - Iso-octyl 3-(3,5-dit-butyl-4-hydroxyphenyl)propanoate
5 - Mixture of mono- and di-nonylated diphenylamine
6 - Dispersant: PIBsuccinimide prepared from 2000 Mn PIB
7 - Ethylene propylene copolymer
8 - Ca Sulfonate: Overbased calcium sulfonate with oil free TBN of 550; metal ratio of 9
9 - The Additional Additives used in the examples include pourpoint depressants, anti-foam agents, corrosion inhibitors, and includes some amount of diluent oil Testing The lubricants are evaluated for wear performance in a programmed temperature high frequency reciprocating rig (HFRR) available from PCS Instruments. HFRR conditions for the evaluations are 200 g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness are then measured with lower wear scar values and higher film formation values indicating improved wear performance.

The percent film thickness is based on the measurement of electrical potential between an upper and a lower metal test plate in the HFRR. When the film thickness is 100%, there is a high electrical potential for the full length of the 1000 micrometer stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact.

The lubricating compositions are tested for deposit control in a Panel Coker heated to 325° C., with a sump temperature of 105° C., and a splash/bake cycle of 120 s/45 s. The airflow is 350 ml/min, with a spindle speed of 1000 rpm and the test lasts for 4 hours. The oil is splashed onto an aluminum panel which is then optically rated by computer. Performance ranges from 0% (black panel) to 100% (clean panel).

The Sequence IIIG engine test simulates high-speed service during relatively high ambient conditions; it measures oil thickening and piston deposits operation and provides information about valve train wear. Lubricants subjected to the Sequence IIIG are evaluated for many parameters including end of test viscosity increase, valve train wear, and oil consumption. In addition, acid number (TAN) and base number (TBN) are monitored throughout the test at 20 hour intervals.

TBN retention and TAN increase are evaluated by the ISOT (Indiana Stirring Oxidation Test), in which an oil sample is placed in a beaker in the presence of an iron, a copper test coupon, and a glass stick. The sample is stirred at 165° C. for 148 hours and the TAN and TBN are measured at the beginning and end of the test. In the same test, copper corrosion is evaluated by measuring the ppm Cu in the lubricant at the end of the test, and oxidative stability of the sample is evaluated in terms of % viscosity increase of the lubricant.

The propensity for a lubricating composition to resist deposit formation is evaluated in the Komatsu Hot Tube (KHT) test. This is an industry test used to evaluate performance of engine oils based on their deposit-forming tendencies by circulating a sample of the engine oil at 0.31 mL per hour and air at 10 mL per minute through a glass tube for 16 hours at a specified temperature, usually from 270° C. up to 310° C. After the test, the tubes are visually rated, with a higher number being a better rating: 10 representing a clean tube and 0 (zero) representing a tube with heavy deposits.

Deposit performance can be measured according to the Thermo-Oxidation Engine Oil Simulation Test (TEOST 33) as presented in ASTM D6335. The results of the TEOST 33 test show the milligrams of deposit after an engine oil is run at elevated temperatures. Lower TEOST 33 results are indicative of improved resistance to deposit formation.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference, as is the priority document and all related applications, if any, which this application claims the benefit of Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); (iii) hetero substituents, that is, substituents which, while having a predominantly hydrocarbon character, in the context of this invention, contain other than carbon in a ring or chain otherwise composed of carbon atoms.

Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A zinc-free lubricating composition comprising: (a) an oil of lubricating viscosity; (b) a zinc-free phosphorus-containing antiwear agent selected from a phosphite, a phosphonate, and an amine phosphate salt in an amount to deliver 0.025 weight percent to about 0.086 weight percent of phosphorous to the composition; (c) at least one ashless detergent comprising a tetra-hydrocarbyl ammonium salicylate having a total base number (D2896) of at least about 50 mg KOH/g and a total acid number (TAN) of less than about 5 mg KOH/g as measured by ASTM D664 where the hydrocarbyl is selected from ethyl, propyl, and butyl; and (d) an ashless antioxidant.

2. The lubricating composition of claim 1, further comprising at least one other additive selected from ashless dispersants, phosphorus-free ashless anti-wear additives, friction modifiers, polymeric viscosity modifiers, corrosion inhibitors, and metal-containing detergents.

3. The lubricating composition of claim 1, wherein the ashless detergent is present in an amount to deliver about 1.5 mg KOH/g to about 12 mg KOH/g of TBN to the lubricating composition.

4. The lubricating composition of claim 1, wherein the ashless antioxidant is selected from a phenolic compound, a diarylamine compound, a sulfurized olefin, or combinations thereof.

5. The lubricating composition of claim 1, wherein the ashless antioxidant is present in an amount of about 0.1 weight % to about 10 weight % in the lubricating composition.

6. The lubricating composition of claim 1, further comprising a polyalkenyl succinimide dispersant in an amount from about 0.5 to about 4 weight % of the composition.

7. A method of lubricating an internal combustion engine comprising lubricating the engine with a lubricant composition comprising: (a) an oil of lubricating viscosity; (b) a zinc-free phosphorus-containing antiwear agent selected from a phosphite, a phosphonate, and an amine phosphate salt in an amount to deliver 0.025 weight percent to about 0.086 weight percent of phosphorous to the composition; (c) at least one ashless detergent comprising a tetra-hydrocarbyl ammonium salicylate having a total base number (D2896) of at least about 50 mg KOH/g and a total acid number (TAN) of less than about 5 mg KOH/g as measured by ASTM D664 where the hydrocarbyl is selected from ethyl, propyl, and butyl; and (d) an ashless antioxidant.

8. The method of claim 7, wherein the engine is fueled with a liquid hydrocarbon fuel, a liquid nonhydrocarbon fuel, or mixtures thereof.

9. The method of claim 7, wherein the engine is fueled by natural gas, liquefied petroleum gas (LPG), compressed natural gas (CNG), or mixtures thereof.

10. The method of claim 7, wherein the lubricant composition further comprises at least one other additive selected from an ashless dispersant, a phosphorus-free ashless anti-wear additive, a friction modifier, a polymeric viscosity modifier, a corrosion inhibitor, and a metal-containing detergent.

11. The method of claim 7, wherein the lubricating composition further comprises a polyalkenyl succinimide dispersant in an amount from 0.5 to 4 weight % of the composition.

12. The method of claim 7, wherein the lubricating composition comprises at least 50 weight % of a Group II base oil, a Group III base oil, or mixtures thereof.

* * * * *